United States Patent [19]

Robert

[11] 4,436,441

[45] Mar. 13, 1984

[54] TYPEWRITER ACCESSORY DEVICE FOR BOLD FACE TYPING

[76] Inventor: George R. Robert, 11 Hackfeld Rd., Worcester, Mass. 01609

[21] Appl. No.: 395,680

[22] Filed: Jul. 6, 1982

[51] Int. Cl.[3] ..... B41J 7/18

[52] U.S. Cl. ..... 400/304; 400/210

[58] Field of Search ..... 400/210, 283, 303, 304; 74/526

[56] References Cited

U.S. PATENT DOCUMENTS

| | | | |
|---|---|---|---|
| 597,038 | 1/1898 | Turner | 400/304 |
| 1,316,727 | 9/1919 | Koressios | 74/526 |
| 1,950,761 | 3/1934 | Thompson | 400/304 |
| 2,410,708 | 11/1946 | Breither et al. | 74/526 |
| 2,544,998 | 3/1951 | Kissell | 400/304 |
| 3,270,851 | 9/1966 | Goldsmith et al. | 400/306.2 |

*Primary Examiner*—Edgar S. Burr
*Assistant Examiner*—John A. Weresh
*Attorney, Agent, or Firm*—James F. Davis; Joseph P. Lavelle

[57] ABSTRACT

Device for use with a typewriter having manual half back space lever to permit making bold face characters. When bold face typing is desired, the device is removably secured to the typewriter, adjacent to the half-space lever, to permit incremental adjustment of the lever and typewriter carriage. By proper adjustment of the lever with the device, restruck characters can be made to have the appearance of bold face.

3 Claims, 4 Drawing Figures

FIG. 1.
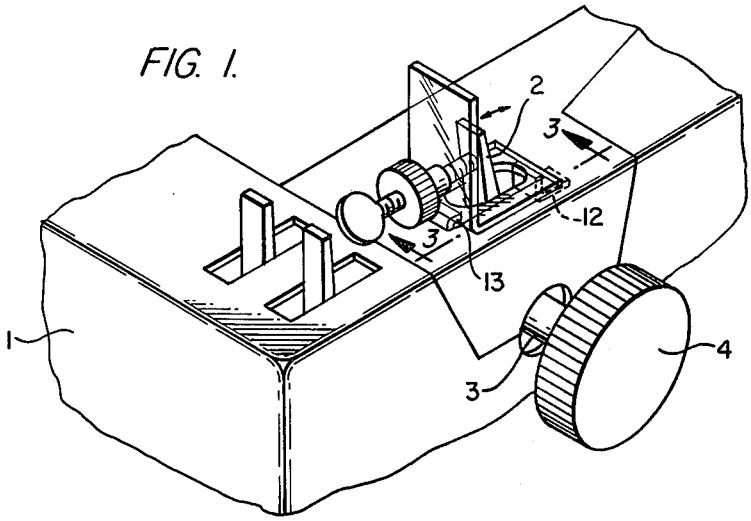
FIG. 2.
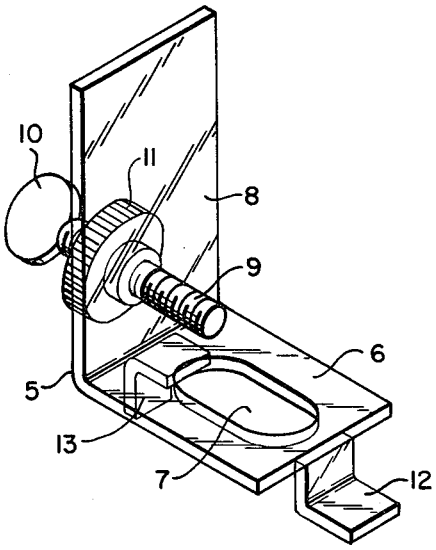
FIG. 3.
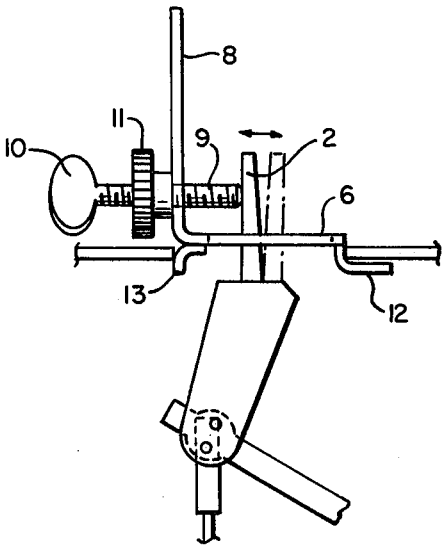
FIG. 4.
type
type

TYPEWRITER ACCESSORY DEVICE FOR BOLD FACE TYPING

BACKGROUND OF THE INVENTION

This invention relates to typewriters, and particularly to a novel device for use with typewriters to create bold face typing.

It is desirable to be able to create type of bold face appearance with a typewriter and efforts have been made to do so in older manual-operated typewriters. For example, U.S. Pat. No. 2,544,998 to Kissell describes a mechanism for partial displacement of the typewriter carriage and printing surface in both a horizontal and vertical direction so as to permit relative displacement of the typed letters on a sheet to create bold face characters. U.S. Pat. Nos. 597,038 (Turner) and 1,950,761 (Thompson) described mechanisms for carriage displacement so as to effect a variation in normal typed-character placement, in particular to create superimposed characters or "shaded" characters. Furthermore, U.S. Pat. No. 3,270,851 (Goldsmith) describes a novel half-space mechanism by which a typist can correct errors and justify margins more easily by half-space displacement of the carriage.

None of these patents, however, describes a simple, inexpensive and effective means for providing bold-face typing in modern electric typewriters having manual half-space mechanisms and removable and interchangeable typing elements, such as the IBM "Selectric" series of typewriters.

SUMMARY OF THE INVENTION

It is therefore an object of this invention to provide a simple, inexpensive and effective device for use with modern typewriters to create bold face type.

It is a further object of this invention to provide a device which can be easily inserted into and removed from a modern typewriter by the typist at will to be able to create bold face type.

It is a further object of this invention to provide a device which can be easily adjusted to provide bold face type with one or more different typing elements of typewriters having interchangeable typing elements.

These and other objects of the invention will become apparent as the invention is described in detail hereinafter.

DETAILED DESCRIPTION OF THE INVENTION

The invention is a device for use in conjunction with the half back space lever and mechanism of a modern electric typewriter, such as the IBM "Selectric" II. The purpose of the half back space lever and mechanism is to permit the typist to move the carrier one half space to the left. By doing so, the typist can then insert characters on a page in positions one-half space from normal within a typed line. By moving the half-space lever to its full position and holding it, the typist maintains the half back space relationship so long as the lever is held in full position and the typist can then type in characters having full spacing with respect to each other but half-spacing with respect to other characters in the line.

The device of the invention permits the half space lever to be held in a position less than full so that the carriage is displaced something less than a complete half space. By making suitable adjustment to the position of the lever, the carriage (and the paper upon which typing is being done) is displaced by a distance proportional to the lever position such that upon typing over a character already typed, the new character is slightly displaced to the left of the old and together the new character and the old gives the appearance of bold face typing.

The invention will now be described in greater detail by reference to the accompanying drawings wherein:

FIG. 1 is a perspective view showing part of the upper end position of an electric typewriter incorporating the invention;

FIG. 2 is a perspective view of the device of the invention;

FIG. 3 is a side view taken along line 3—3 of FIG. 1; and

FIG. 4 is an illustration showing how bold face typing appears on a typed sheet when using the invention.

FIG. 1 shows the upper end portion of an electric typewriter 1, such as an IBM "Selectric" II, well known in the art, with the device of the invention in place. It will be understood that during normal typing, the device is not in place as shown in FIG. 1 but is inserted only when bold face typing is desired. Half-space lever 2 is connected by an operating link mechanism (not shown) to the typewriter platen, the end of which is shown at 3 having a hand knob 4 for rotating the platen, all as is well known in the art. Half space lever 2, in normal use without the present invention, is in a position toward the left as shown in FIGS. 1 and 3; and in such position, the carrier is not displaced. If the typist desires to displace the carrier by one-half space, lever 2 is moved fully to the right thus displacing the carriage 3 one half space back. When held fully to the right by hand while typing is done, all typed characters are displaced one-half space to the left. When half spacing is no longer desired, the typist simply releases lever 2 which returns to its position to the left and the carrier returns to its normal position.

FIG. 2 shows the device of the invention in detail. The device comprises a frame, shown generally at 5, having a base 6 with a hole 7 throuh which lever 2 extends when the device is in place on the typewriter as shown in FIG. 1. Frame 5 also has a support member 8, generally at right angles to base 6, which carries a screw 9. The hole in member 8 through which screw 9 extends is threaded so that screw 9, by means of wing end 10 may be screwed into and out of the device by finger turning. Lock nut 11 on screw 9 permits the screw to be secured in place at any desired position by rotating nut 11 tightly up against member 8.

Base 6 also has two lugs 12 and 13 by which the device is secured into position on the body of the typewriter as shown in FIGS. 1 and 3. Frame 5 and lugs 12 and 13 can be made of any suitable rigid material such as metal, plastic or the like. Lugs 12 and 13 are of a width sufficient to ensure that when the device is placed into position on the typewriter (FIG. 1), the device cannot move sideways.

In operation, the device of the invention is mounted by lugs 12 and 13 into position over lever 2 as shown in FIG. 1. Screw 9 is then adjusted forward to engage lever 2 and to press it forward (to the right in FIGS. 1 and 3). As lever 2 is pressed, carrier 3 begins to be displaced by an amount proportional to the movement of lever 2. By trial and error, the typist moves lever 2 by adjusting screw 9 until a typed-over character appears in the degree of bold face desired by the typist. Within a determinable (by trial and error) range of position of lever 2 (as determined by the extent of movement of screw 9) the typist can adjust the bold face appearance to be heavy or light. When the desired degree of bold face is obtained, the typist locks lever 2 into position by tightening lock nut 11 on screw 9. In this way, the typist can continue to type over other characters in a line to make them bold face all to the same degree.

FIG. 4 illustrates how bold face is produced and appears. The upper word "type" illustrates the word in normal typewriter characters. If the typist wishes the word "type," or any letters thereof to appear bold face, the typist backspaces to the letter "t", then mounts the device of the invention over lever 2. If the screw 9 has previously been adjusted to the proper position for the particular typing element being used, the typist merely restrikes the letters desired to be bold face. FIG. 4 shows the result of restriking the letters "t", "y" and "p". Upon removing the device from the typewriter, the typist can return to normal typing.

It should be clear from the above description of the invention that the most efficient use of the invention is to have one device for each typing element used with a particular typewriter. In this way, a typist can preadjust and lock the position of screw 9 for each typing element and be prepared to make bold face type immediately upon need with any element without having to go through any re-adjustments.

Having disclosed the invention, I claim:

1. A device for creating bold type for use with a typewriter having a half-space lever, the device comprising: (a) a frame adapted to be positioned adjacent the half-space lever said frame having: (i) a base with securing lugs affixed to said base, and (ii) a support member integral with said base, (b) first means adjustably mounted on said support member for contacting said lever, (c) and second means for securing said first means into a pre-selected position with respect to said support member.

2. Device of claim 1 wherein said first means is a screw having at one end a wing portion to permit finger adjustment of said screw.

3. Device of claim 2 wherein said second means is a lock nut on said screw.

* * * * *